United States Patent [19]

Brockman et al.

[11] 4,299,535

[45] Nov. 10, 1981

[54] FAN INLET GUIDE VANE ASSEMBLY

[75] Inventors: George T. Brockman; Thomas A. Garavalia, both of Stoddard; Richard W. Kabat, Genoa, all of Wis.

[73] Assignee: The Trane Company, La Crosse, Wis.

[21] Appl. No.: 209,766

[22] Filed: Nov. 24, 1980

[51] Int. Cl.[3] ..... F04D 29/46
[52] U.S. Cl. ..... 415/160
[58] Field of Search ..... 415/160, 161, 162

[56] References Cited

U.S. PATENT DOCUMENTS

| | | | |
|---|---|---|---|
| 2,063,174 | 12/1936 | Leonard | 230/114 |
| 2,435,092 | 1/1948 | Meyer | 230/114 |
| 2,621,848 | 12/1952 | Bentley | 230/114 |
| 2,746,713 | 5/1956 | Peyrin et al. | 415/160 |
| 2,827,224 | 3/1958 | Madison et al. | 230/114 |
| 3,056,541 | 10/1962 | Foweraker | 230/114 |
| 3,566,916 | 3/1971 | Root | 137/601 |
| 4,130,375 | 12/1978 | Korta | 415/161 |
| 4,177,007 | 12/1979 | Schlangen et al. | 415/160 |
| 4,187,879 | 2/1980 | Fermer et al. | 137/601 |
| 4,239,450 | 12/1980 | Geitner et al. | 415/160 |

FOREIGN PATENT DOCUMENTS

| | | | |
|---|---|---|---|
| 1181816 | 6/1959 | France | 415/160 |
| 991444 | 5/1965 | United Kingdom | 415/160 |
| 1041203 | 1/1953 | Fed. Rep. of Germany . | |
| 2113194 | 3/1971 | Fed. Rep. of Germany . | |
| 2250559 | 10/1972 | Fed. Rep. of Germany . | |
| 318054 | 11/1967 | Sweden . | |

OTHER PUBLICATIONS

Trane Company Drawing, dated 2-2-61, No. 3103.

*Primary Examiner*—Louis J. Casaregola
*Attorney, Agent, or Firm*—Carl M. Lewis; Peter D. Ferguson; Ronald M. Anderson

[57] ABSTRACT

An inlet guide vane assembly for controlling air flow through a fan. A plurality of shafts are mounted extending radially inward of an inlet cone, and are affixed to a hub positioned at the center of the cone and concentric thereto. Rotatably mounted on each shaft is an adjustable inlet vane, having a crank arm extending from its root end. Cam follower bearings are used to rotatably mount a ring on the hub. The ring is connected to each of the crank arms by a link having a ball and socket joint at each end. Rotation of the ring thereby causes the inlet vanes to rotate about their supporting shafts without binding.

13 Claims, 4 Drawing Figures

FAN INLET GUIDE VANE ASSEMBLY

TECHNICAL FIELD

This invention generally pertains to fan flow regulation apparatus and specifically, to an inlet guide vane assembly for a fan.

BACKGROUND ART

Inlet guide vanes are commonly used with centrifugal fans having fan wheels with backward inclined, air foil or flat blades. The inlet vanes impart a spin to the air such that it enters the fan wheel in the direction of rotation. This results in decreased air flow, lower static discharge pressure, and decreased brake horsepower requirements. Adjustment of the inlet vane angle provides modulation of air flow over a relatively broad range with substantial savings in operating costs when compared to other modulation techniques, such as use of discharge air dampers.

The prior art includes numerous designs for adjustable inlet guide vane mechanisms. Generally, all such devices provide means for simultaneously adjusting the inlet vanes between an extreme open position, allowing maximum air flow, and an extreme closed position, allowing a minimum air flow. The means for adjusting the vanes ideally should be infinitely variable, free of binding but without excessive "slop" or free-play, and of simple design and construction to avoid excessive manufacturing costs.

Inlet guide vane designs found in the prior art can generally be divided into two groups--those in which the inlet vanes are adjusted by means exterior to the hub, and those in which they are adjusted by means adjacent to the center of the inlet. Examples of the former group include inventions disclosed in U.S. Pat. Nos.: 2,435,092; 2,621,848; 2,827,224; 3,056,541; 3,566,916; and 4,177,007. Each of these patents shows an assembly with vanes fixedly mounted on shafts which at one end extend radially through an inlet cone or shroud. A crank arm is attached to the extending end of each shaft and connected to means for rotating the shafts with their attached vanes. Although the patents differ substantially in the apparatus disclosed for rotating the shafts, such means typically include a ring connected with a flexible joint or link assembly to each crank arm. An exception is the '541 patent, in which the crank arm of adjacent shafts are interconnected with links having a ball and socket joint at each end.

U.S. Pat. Nos. 2,063,174 and 4,187,879 describe examples of the latter group, in which the vanes are rotated about fixed shafts by means disposed adjacent a hub at the center of the inlet cone. In the '174 patent, a conical-shaped rotary member is journaled on the hub and has longitudinal grooves formed therein for receipt of a follower which extends from the root end of each vane; the hub is rotated to adjust all the vanes simultaneously.

The '879 patent shows an adjustment ring located at one side of a hub and concentric to the inlet cone. A crank arm extends from the root end of each vane at a very precise compound angle relative to the axis of the shaft. Each crank arm is connected to the adjustment ring with a single ball and socket joint. The socket member of this joint is square shouldered to fit a similarly shaped hole in the crank arm. As the adjustment ring is rotated, the ball rotates within the socket member and the socket slides back and fourth within the hole in the crank arm. The combined motion is apparently necessary to provide the required articulation to avoid binding as the vanes are adjusted.

Both the '879 and the '174 patent claim to provide a simple and inexpensive inlet vane adjustment mechanism; yet, each is somewhat complex and expensive to build, especially for use with smaller fans in light industrial air conditioning applications. For example, an expensive machining operation is required to produce the conical-shaped ring with the follower grooves shown in the '174 patent; likewise, in the '879 patent it is apparently necessary to form the crank arm at a complex angle with a precision of 0.5°, to avoid binding of the ball and socket joint as the vanes are moved. Since it is essential that manufacturing costs be extremely low to economically justify use of inlet vanes on smaller fans, the prior art does not appear to provide a sufficiently low cost design.

In consideration thereof, it is an object of this invention to provide an inlet guide vane mechanism which is both simple to manufacture and which uses relatively inexpensive parts.

It is a further object of this invention to provide means for simultaneously adjusting the inlet vanes of such an assembly without binding the moving parts thereof.

It is still a further object of this invention to provide such an assembly in which there is minimum vane free-play, and in which rotation of the vanes may be precisely effected.

These and other objects of the present invention will be apparent from the disclosure which follows and by reference to the attached drawings.

DISCLOSURE OF THE INVENTION

A fan inlet assembly is disclosed for controlling air flow through an inlet cone adapted to be disposed at the inlet of a fan. A plurality of shafts each have one end affixed to the inlet cone and extend radially inward thereof, toward its center. The inwardly extending ends of these shafts are affixed to a hub which is concentrically centered in the inlet cone.

An adjustable inlet vane is rotatably mounted on each shaft between the hub and the inlet cone. A crank arm extends from the end of each vane adjacent the hub, or root end, and is connected by a link to a ring rotatably mounted on the hub.

The link has a ball and socket joint at each end to movably connect the crank arms to the ring. Rotation of the ring about the hub thereby causes the inlet vanes to rotate simultaneously about their respective supporting shafts without binding.

DESCRIPTION OF THE PREFERRED EMBODIMENTS

Figure 1:
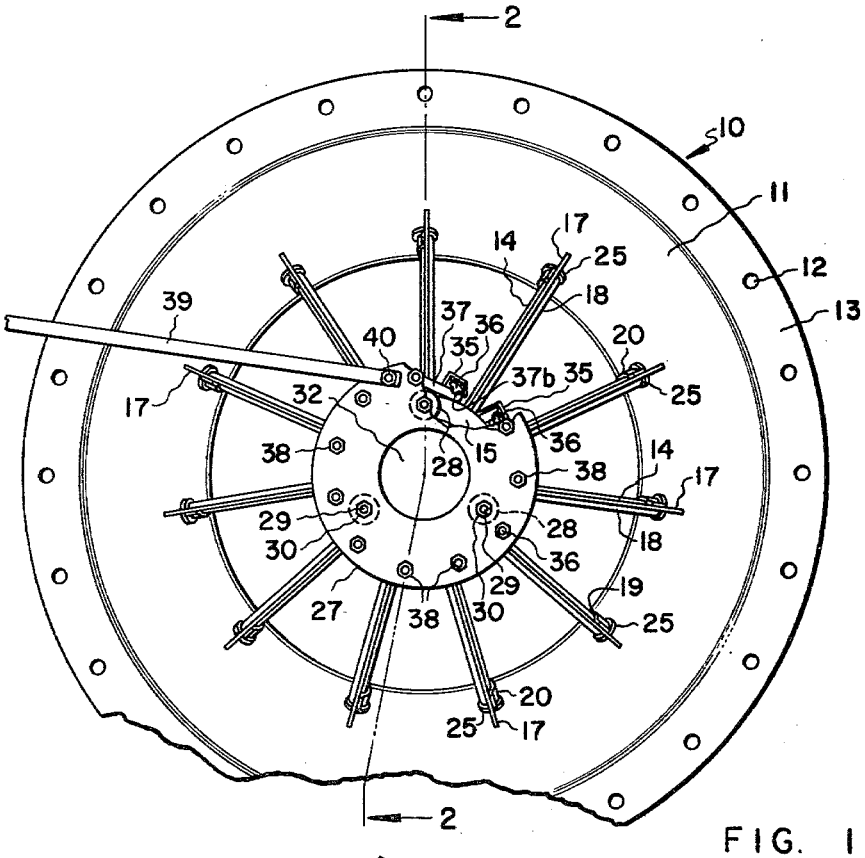
FIG. 1 shows a side elevational view of a first embodiment of an inlet guide vane assembly incorporating the subject invention.
Figure 2:
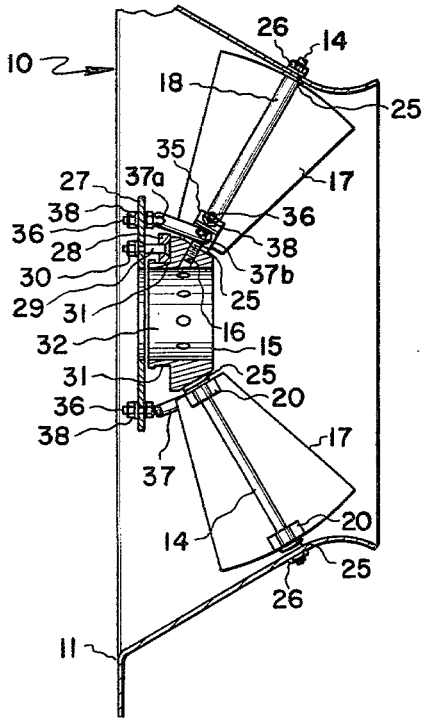
FIG. 2 is a cross-sectional view of the inlet guide vane assembly taken along section line 2—2 of FIG. 1.

With reference to FIGS. 1 and 2, an inlet guide vane assembly generally denoted by reference numeral 10 is shown as it would appear from the air inlet side of a fan housing to which the inlet guide vane assembly 10 is adapted for mounting. Typically, the inlet guide vane assembly 10 is used in conjunction with a centrifugal fan (not shown), and is mounted so that it extends into the air inlet portion of the fan wheel from one side of the fan's housing. An inlet cone 11 defines the airflow through assembly 10 and includes a lip 13 having mounting holes 12 at spaced intervals.

It will be understood that during operation of an attached fan, air flows through the inlet cone 11 in a direction toward the narrow diameter portion. In both of the preferred embodiments, inlet cone 11 is formed of spun steel, having a relatively smooth aerodynamic surface and shape to minimize flow impedance.

A plurality of shafts 14 support a hub 15 concentrically centered within inlet cone 11. The shafts 14 each have one end threaded into tapped holes 16 radially disposed at an inclined angle in the hub 15. The other ends of shafts 14 extend generally radially outward through the inlet cone 11 and serve as pivots for a plurality of vanes 17 which are attached thereto. Each vane 17 is of generally trapezoidal shape, having a wider end which is adjacent to the inlet cone 11 and curved to provide adequate clearance as the vane 17 rotates on shaft 14. A depression 18, formed in a half-round shape with a diameter slightly larger than that of the shafts 14, extends the length of the longitudinal axis of each of the vanes 17. The vanes 17 further comprise a bearing 19 mounted at each of the depression 18 and held in place by end caps 20. End caps 20 are formed as half-round sections with tabs on each side, and are spot welded to the vanes 17. Bearings 19 further include a flange 25 which acts as a bearing surface at each end of the vanes 17, against the inner surface of inlet cone 11 and the hub 15. In both of the preferred embodiments, bearings 19 are sintered bronze, oil impregnated bushings to insure relatively maintenance free, non-binding rotation of the vanes 17 about shafts 14.

During assembly, shafts 14 are inserted from the exterior of inlet cone 11 through the bearings 19 and are threaded into the holes 16 within hub 15. The extending ends of shafts 14 are threaded to accept nuts 26 which are tightened only enough to support the shaft and hub assembly without causing binding as vanes 17 rotate. Nuts 26 are thereafter tack-welded to the exterior surface of inlet cone 11 to prevent them from loosening.

An adjustment ring 27 is provided adjacent the outwardly facing end of hub 15 and concentric thereto, and is supported with cam follower bearings 28. These extend to one side of the adjustment ring 27, rotatably attached with bolts 29 and nuts 30. Cam follower bearings 28 include either a plastic bearing surface or bronze bushing for low friction rotation about the bolts 29. Their peripheral surface rolls about the hub 15 within groove 31. Adjustment ring 27 is formed of stamped steel and is provided with an opening 32 of appropriate diameter to accommodate a fan wheel drive shaft (not shown) which extends through the center of inlet guide vane assembly 10.

The vane assembly 10 further comprises a crank arm 35 welded to the root end of each of the vanes 17. Crank arm 35 is bent at two places so that it extends both radially away from the hub 15, and generally toward the adjustment ring 27. Bolts 36 having a generally ball-shaped head are attached with nuts 38 to the extending ends of crank arms 35, and are also disposed at spaced intervals on the planar surface of adjustment ring 27 so that the ball-shaped heads extend toward hub 15. Links 37 are provided with generally spherical shaped sockets **37*a* and 37*b* at each end thereof to accommodate the heads of bolts 36. Sockets 37*a* and 37*b* are slightly larger in diameter than the ball-shaped heads of the bolts 36 and are swaged to hold bolts 36 in place while allowing them to rotate about multiple axes. Sockets 37*a* and 37*b* in combination with one each of the ball-shaped bolts 35 on ring 27 and on the extending ends of crank arms 35 thus comprise ball and socket joints, with links 37 connecting each of the crank arms 35 to the adjusting ring 27**.

An actuator arm 39 is connected to the opposite planar surface (outward facing) of adjustment ring 27 by means of ball and socket clamp fitting 40; arm 39 extends beyond the periphery of the inlet guide vane assembly 10 where it may be connected to an electrical or pneumatic actuator which provides the necessary push-pull force for adjusting the vanes 17 to regulate the airflow through a fan.

Figure 3:
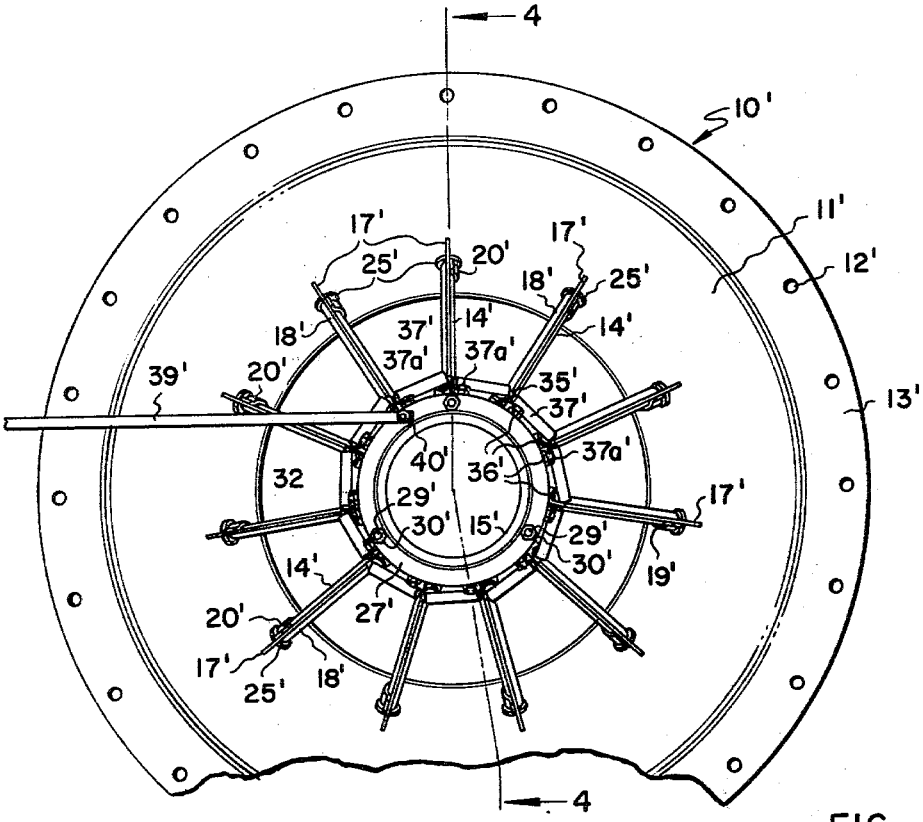
FIG. 3 is a side elevational view of the second embodiment of the subject invention.
Figure 4:
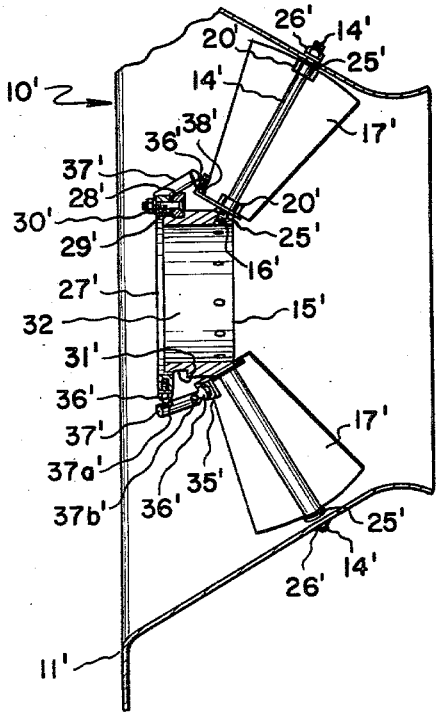
FIG. 4 is a cross-sectional view of the second embodiment taken along section line 4—4 of FIG. 3.

Turning now to FIGS. 3 and 4, a second preferred embodiment of the subject invention is shown in similar aspect to that of FIGS. 1 and 2, respectively. Each of the elements comprising the second embodiment are generally similar in operation, function, and disposition to those of the first embodiment, with the exception of the shape of crank arms 35', and the disposition of links 37' and bolts having ball-shaped heads 36'. As will be noted, each of the elements in the second embodiment is differentiated in the drawings from those elements comprising the first embodiment by the "prime" designation; except where noted, common numeric designation otherwise indicates equivalent function and operation of the designated elements.

Further differences include the relatively larger diameter of opening 32' provided in hub 15' and adjustment ring 27', thereby adapted to accommodate a fan impeller shaft having a larger diameter than that of the first embodiment. It is perhaps appropriate at this point to explain that during manufacture, hubs 15 and 15' are each machined to the indicated shape from a section of thick-walled tubing rather than being cast. Hubs 15 and 15' are thus produced at relatively low cost by machining on a lathe or by more automated means using techniques well known in the art.

As shown clearly in FIG. 4, bolts having ball-shaped heads 36' are attached at regularly spaced intervals around the *periphery* of the adjustment ring 27', rather than on its *planar surface* as shown in the first embodiment. This permits the use of an adjustment ring 27' having a relatively small diameter compared to the diameter of opening 32', and further minimizes resistance to airflow entering the inlet cone 11'. To accommodate the position of bolts 36' on the periphery of adjustment ring 27', crank arms 35' extend from the root end of vanes 17' toward the hub 15' and are bent radially outward at an angle so that their tips extend generally parallel to the shafts 14. Links 37' thus connects bolts 36' on the periphery of adjustment ring 27' to bolts 36' on the extending end of crank arms 35'.

In the operation of both embodiments, as hereinbelow explained with reference only to the common numeric designation of elements, displacement of actuator arm 39 causes adjustment ring 27 to rotate about the hub 15 on cam follower bearings 28. The rotational movement of adjustment rings 27 is transmitted to each of the crank arms 35 by links 37. This motion causes the vanes 17 to rotate about the shafts 14. In this manner, the actuator means (not shown) causes the vanes 17 to assume a precise angular position to deflect air flowing through the inlet cone 11 into the direction of rotation of an attached fan impeller, to the degree desired. The actuator thus accurately controls output volume from the fan.

The ball and socket joints comprising sockets 37*a* and 37*b* and the ball-shaped heads of bolts 36 provide the necessary control precision and articulation to avoid binding during the complex transformation from the rotational movement by adjustment ring 27 in one plane to the rotational movement of each vane 17 in another plane. The inlet guide vane assembly 10 achieves this function using only low-cost, readily available parts, which are typically either stamped from sheet metal or produced with minimal machining costs.

It will be apparent to one skilled in the art, that the inlet guide vane assembly 10 could be built using different means for attaching the shafts 14 to the inlet cone 11 such as by welding; and further, that the hub 15 could be journaled so that it supports the fan impeller shaft. As a further modification, end cap 20 at the root end of each vane 17 may be eliminated, since the bearing 19 may be held in place by the crank arm 35. It will also be apparent that bolts 36 could be provided with a socketed head to accommodate ball-shaped ends on the link 37, thus reversing the ball and socket relationship of the elements. While the invention has been described with respect to the preferred embodiments, it is to be understood that modifications such as those noted above will be apparent to those skilled in the art within the scope of the invention, as defined in the claims which follow.

We claim:

1. A fan inlet assembly comprising (a) an inlet cone adapted to be disposed at the inlet of a fan for directing airflow therethrough;

(b) a plurality of shafts, each having one end affixed to the inlet cone and generally extending radially inward therefrom toward its center;

(c) a hub disposed generally at the center of the inlet cone and concentric thereto, said hub being affixed to the inwardly extending ends of the shafts;

(d) an adjustable inlet vane rotatably mounted on each shaft between the hub and the inlet cone and having a root end disposed adjacent the hub, each inlet vane having a crank arm attached near its root end;

(e) an annular member disposed within the airflow and movably mounted on said hub for rotation about the hub; and (f) a link having ball and socket joints disposed at each end thereof, used for movably connecting each of the crank arms to the annular member in a manner such that rotation of the annular member about the hub causes the inlet vanes to rotate simultaneously about their respective supporting shafts, without binding.

2. The fan inlet assembly of claim 1 wherein said ball and socket joints comprise generally ball-shaped projections disposed adjacent the end of each crank arm and in spaced apart attachment around the annular member, and receptacles disposed adjacent each end of the connecting links; said receptacles being appropriately sized to accommodate the projections therewithin and with provision for substantial rotational movement of the projections within the receptacles.

3. The fan inlet assembly of claim 1 wherein the hub is supported by the inwardly extending shafts.

4. The fan inlet assembly of claim 1 wherein the hub includes a circumferential groove for use in mounting the annular member.

5. The fan inlet assembly of claim 4 further comprising a plurality of rollers attached to the annular member at intervals around the hub and disposed to roll around the hub within said groove.

6. The fan inlet assembly of claim 5 wherein the annular member is a ring-shaped disc and the rollers are attached to a planar surface of the disc.

7. The fan inlet assembly of claim 6 wherein the ball and socket joints at one end of each connecting link are disposed adjacent the perimeter of the disc.

8. The fan inlet assembly of claim 6 wherein the ball and socket joints at one end of each connecting link are disposed adjacent the planar surface of the disc.

9. A fan inlet assembly comprising (a) an inlet cone adapted to be disposed at the inlet of a fan and operative to direct airflow therethrough by its convergent shape;

(b) a plurality of shafts, each having one end affixed to the inlet cone and extending inwardly therefrom toward its center;

(c) a hub having a generally cylindrical shape and disposed generally at the center of the inlet cone and concentric thereto, said hub being affixed to said inwardly extending shafts;

(d) a plurality of adjustable inlet vanes, each mounted on one of the shafts between the inlet cone and the hub and having a root end adjacent the hub, and each having a crank arm extending from said root end;

(e) a ring mounted upon the hub and supported thereby within the airflow so that it can be rotated around the center of the hub; and (f) means for connecting the crank arm of each vane to the ring such that when the ring is rotated about the hub, the inlet vanes are caused to rotate simultaneously about their respective shafts without binding, said connecting means including a link having a socket at each end, a first generally ball-shaped projection attached to one of the crank arms, and a second generally ball-shaped projection attached to the ring, said first and second projections being movably secured in the sockets at each end of the link.

10. The fan inlet assembly of claim 9 further comprising a plurality of cam follower roller bearings attached to the ring at spaced apart intervals around the hub, said roller bearings riding in a groove circumferentially inscribed in the hub.

11. The fan inlet assembly of claim 9 wherein the hub is supported by the inwardly extending shafts.

12. The fan inlet assembly of claim 9 wherein the ring is disc shaped and the second ball-shaped projections extend from the planar surface thereof.

13. The fan inlet assembly of claim 9 wherein the second ball-shaped projections extend radially from the perimeter of the ring.

* * * * *